United States Patent [19]

Sohn

[11] Patent Number: 4,703,225

[45] Date of Patent: Oct. 27, 1987

[54] PLASMA DISPLAY DEVICE

[75] Inventor: Sang H. Sohn, Kumi-si, Rep. of Korea

[73] Assignee: Gold Star Co., Ltd., Seoul, Rep. of Korea

[21] Appl. No.: 808,815

[22] Filed: Dec. 13, 1985

[30] Foreign Application Priority Data

Dec. 13, 1984 [KR] Rep. of Korea ..... 13135/1984[U]

[51] Int. Cl.[4] ..... H01J 17/49; H01J 61/067

[52] U.S. Cl. ..... 313/587; 313/582

[58] Field of Search ..... 313/584, 585, 586, 587, 313/582

[56] References Cited

U.S. PATENT DOCUMENTS 3,801,851 4/1974 Andoh et al. ..... 313/586

4,091,305 5/1978 Poley et al. ..... 313/586

4,297,613 10/1981 Aboelfotoh ..... 313/584 X

*Primary Examiner*—David K. Moore

*Assistant Examiner*—K. Wieder

*Attorney, Agent, or Firm*—Birch, Stewart, Kolasch & Birch

[57] ABSTRACT

The present invention relates to a plasma display device which is actuated by a low starting voltage while producing high brightness, which comprises aluminum strips with thickness of about 500 A deposited on dielectric glass layers, in parallel to existing column and row electrodes respectively, and corresponding chemically etched portions to a depth of about 500 A in the magnesium-oxide protective layers, parallel to the column and row electrodes, respectively.

5 Claims, 4 Drawing Figures

PLASMA DISPLAY DEVICE

BACKGROUND OF THE INVENTION

The present invention relates to a plasma display device which functions by the discharge of gases, and more particularly to a plasma display device which is driven at a lower voltage while providing a higher brightness.

There are many types of conventional display devices wherein the discharge of gas is effected by exciting a mixed gas of neon plus argon contained in a gas cell with electrons discharged from row and column electrodes by an external a.c. (alternate current) pulse voltage, Such devices radiate reddish-yellow beams having a wavelength of 6000 to 7000 angstroms discharged from the mixed gas of neon plus argon in the gas cell. However, such devices cannot easily emit electrons and emit only few number of electrons, although the external a.c. pulse voltage is applied since the row and column electrodes thereof are covered with dielectric glass layers and protective layers. Such devices, therefore, require the enhancement of the discharge initiating voltage while exhibiting poor brightness.

SUMMARY OF THE INVENTION

It is an object of the present invention to provide an improved plasma display device for enhancing the voltage efficiency and increasing the brightness of the plasma display device by eliminating or reducing deficiencies of conventional plasma display devices as previously mentioned.

According to the present invention, a plasma display device having a low driving voltage and high brightness is achieved by depositing aluminum metal layers along row and column electrodes on dielectric glass layers and then chemically etching magnesium-oxide protective layers to a thickness of about 500 angstroms, along the row and column electrodes of plasma display device.

BRIEF DESCRIPTION OF THE DRAWINGS

This and other objects and advantages of the present invention will become clear from the following description with reference to the accompanying drawings wherein.

DETAILED DESCRIPTION OF THE INVENTION

Figure 1:
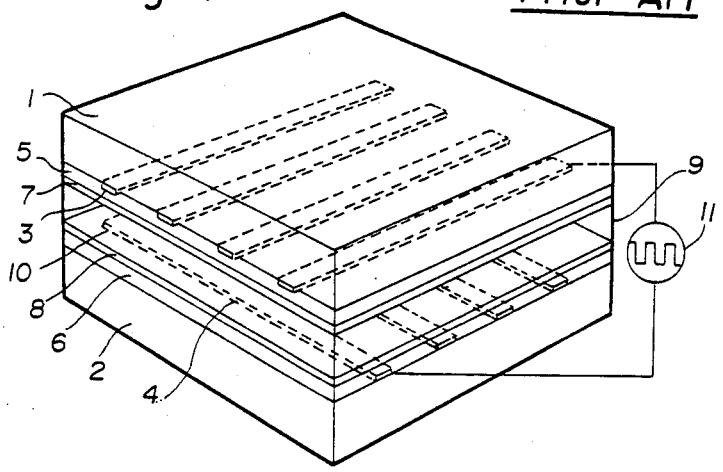
Fig 1 Prior Art
FIG. 1 is a perspective view of a conventional plasma display device.

Referring to FIG. 1, which illustrates a perspective view of a conventional plasma display device for convenience of the explanation of the present invention, there is seen a device having deposited therein a sequence of column electrodes (3) and row electrodes (4) in parallel planes and perpendicular to each other, with tin-oxide on the respective upper and lower substrates of soda glass (1) and (2), and coated with the dielectric glass layers (5) and (6) having a thickness of approximately 25 μm. The device is formed with magnesium-oxide protective layers (7) and (8) having a thickness of approximately 2000 angstroms in order to prevent the dielectric glass layers (5) and (6) from being damaged by electrons or ions emitted by the discharge of gas. A square spacer (9) is provided in such a manner that the magnesium-oxide protective layers (7) and (8) are oppositely disposed within the space provided of 100 μm, to form the gas cell chamber (10). The gas cell (10) is sealed by injecting neon plus an infinitesimal amount of argon into the gas cell (10) at the pressure of 200 to 500 Torr and thereafter an a.c. pulse voltage (11) is applied with 90 to 100 volts, between the column electrodes (3) and row electrodes (4).

In this conventional plasma display device, when the a.c. pulse voltage (11) is applied between the column electrodes (3) and the row electrodes (4), electrons are emitted from the surfaces of the magnesium-oxide protective layers (7) and (8), so that the neon and argon gases contained in the gas cell (10) are excited and impacted, thereby emitting reddish-yellow beams having a wavelength of from 6000 to 7000 angstroms. However, because the column electrodes (3) and the row electrodes (4) are covered by the dielectric glass layers (5) and (6) and the magnesium-oxide protective layers (7) and (8), the number of electrons which are emitted from the surfaces of magnesium-oxide protective layers (7) and (8) are limited thereby requiring a high voltage (more than 100 volts) in initiating the discharge. When a limited number of electrons for exciting the neon and argon are emitted there results a lowering in the frequency of emitting reddish-yellow beams produced to a poor brightness (the brightness is proportional to the frequency of impact).

Figure 2:
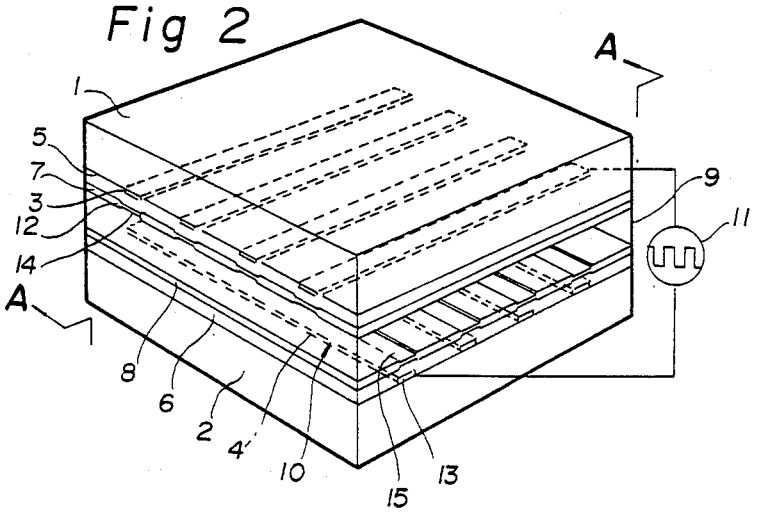
FIG. 2 is a perspective view of the plasma display device according to the present invention.
Figure 3:
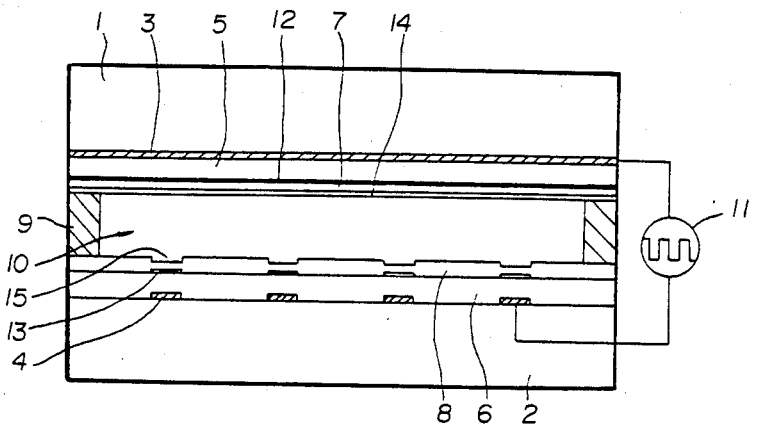
FIG. 3 is a cross-sectional view taken along line A—A of the device in FIG. 2.
Figure 4:
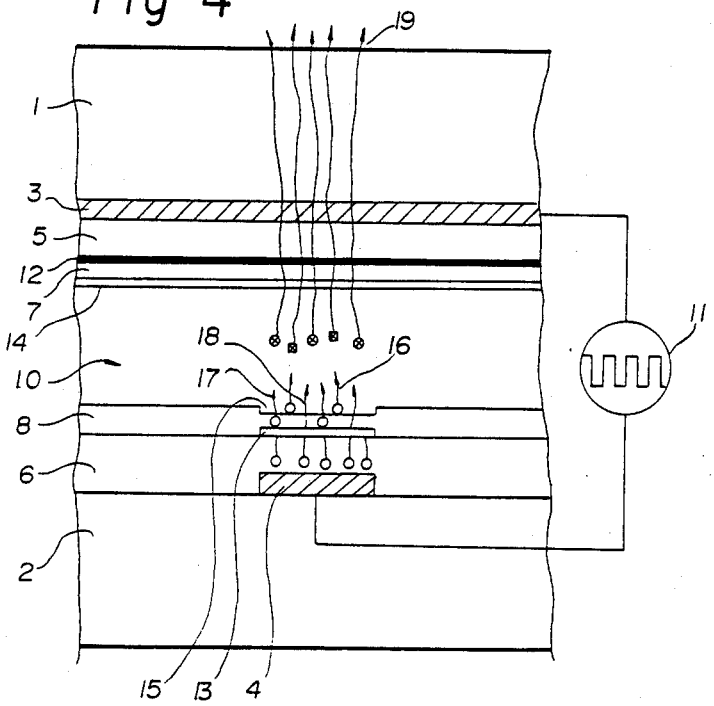
FIG. 4 is an enlarged sectional view showing in detail a portion of the device of FIG. 3.

Referring to FIGS. 2 and 3, which represent the perspective view and the cross-sectional view of the present invention respectively, there is seen the plasma display device of the present invention with aluminum metal strips (12) and (13) having a thickness of about 500 angstrom on the upper portions or surfaces of dielectric layers (5) and (6) as columns and rows in a parallel relationship with the column electrodes (3) and row electrodes (4), respectively. The surface or upper portions of magnesium-oxide protective layers (7) and (8) are chemically etched in directions parallel with and corresponding to the column electrodes (3) and row electrodes (4), respectively, to form each etched sections (14) and (15) at a depth of about 500 angstroms corresponding to the aluminum vapor deposited metal strips.

In the present invention, the aluminum metal strips (12) and (13) with a thickness of about 500 angstroms are formed on the upper portions or surfaces of dielectric glass layers (5) and (6) respectively, while the etched sections (14) and (15) having a depth of about 500 angstroms are formed on the upper portions or surfaces of the magnesium-oxide protective layers (7) and (8) respectively. The magnesium-oxide protective layers (7) and (8) are formed to a thickness of about 2000 angstroms, so that the thickness of the magnesium-oxide protective layers (7) and (8), between the aluminum metal layers (12) and (13) and the gas cell chamber (10) becomes about 1000 angstroms.

Therefore, in the present invention, when the a.c. pulse voltage (11) is applied between the column electrodes (3) and row electrodes (4), the electrons emitted from the surfaces of the column and row electrodes are effectively carried by and transmitted from the surfaces of the aluminum metal strips (12) and (13) and from the surfaces of magnesium-oxide protective layers (7) and (8) in this order and then are introduced to the gas cell chamber (10). In other words, electrons (16) are more effectively emitted from the surface of the magnesium-oxide protective layer (8) directly to the gas cell chamber (10) as a result of the presence of the aluminum metal strips (12) and (13) by a tunnelling effect resulting from the etched section (15) of the magnesium-oxide protective layer (8). Electrons (17) and (18) are respectively emitted from the surface of row electrode (4) and applied to the gas cell chamber (10), because the thickness of magnesium-oxide protective layer (8) between the aluminum metal layer (13) and the gas cell (10) has been reduced to a thickness of about 1000 angstroms for causing the tunnelling effect as described above.

Electrons (16),(17) and (18) applied to the gas cell (10) as previously described, emit and excite the neon (denoted as ⊗) and argon (denoted as ⊠) to radiate reddish-yellow beams having a wavelength of rom 6000 to 7000 angstroms.

Furthermore, when the polarity of the a.c. pulse voltage is (9) applied between the column electrodes (3) and the row electrodes (4), in a similar manner, electrons are emitted from the surface of the column electrodes (3), the surface of aluminum metal strips (12) and the surface of magnesium-oxide protective layer (7) and introduced to the gas cell chamber (10). The electrons impact and excite the neon and argon gases whereby the plasma display device radiates the reddish-yellow beams having a wavelength of from 6000 to 7000 angstroms.

As described above, in the plasma display device according to the present invention, when the a.c. pulse voltage is applied all of the electrons emitted from the surfaces of the column and row electrodes, the surfaces of aluminum metal strips and the surfaces of magnesium-oxide protective layers are applied to the gas cell, so that the number of electrons applied to the gas cell are greatly increased as compared with that of the conventional plasma display device. Accordingly, a lower discharge initiating voltage or driving voltage of the device of the present invention is required and the efficiency and therefore brightness of the reddish-yellow beams radiated enhanced.

While the described embodiment represents the preferred form of the present invention, it is to be understood that modifications will occur to those skilled in the art without departing from the spirit of the invention. The scope of the invention is therefore to be determined solely by the appended claims.

What is claimed is:

1. A low voltage, high brightness plasma display device comprising in combination, sequentially:
   - upper and lower glass substrates,
   - a multiplicity of column electrodes formed on a lower surface of said upper glass substrate and a multiplicity of row electrodes formed on the upper surface of said lower glass substrate, said column and rows of electrodes being formed so as to be perpendicular one to the other while existing in planes parallel one to the other,
   - dielectric glass layers coated over said electrode bearing surfaces of said substrates,
   - magnesium-oxide protective layers formed respectively on each of said dielectric glass layers to define a gas cell disposed therebetween,
   - spacer member sandwiched between said structured upper and lower glass substrates creating a discharge gas cell chamber disposed therebetween,
   - metal strips deposited on said respective dielectric glass layers parallel to said column electrodes and row electrodes respectively, and
   - etched sections on said magnesium-oxide protective layers corresponding to each of said metal strips.

2. The plasma display device of claim 1, wherein said magnesium-oxide protective layers have a thickness of about 2000 angstroms.

3. The plasma display device of claim 1, wherein said metal strips are aluminum strips.

4. The plasma display device of claim 3, wherein said aluminum metal strips have a thickness of about 500 angstroms.

5. The plasma display device of claim 1, wherein said etched sections have a depth of about 500 angstroms.

* * * * *